US006382520B1

(12) United States Patent
Hones

(10) Patent No.: US 6,382,520 B1
(45) **Date of Patent: *May 7, 2002**

(54) DECORATIVE WATERFALL DEVICE AND METHOD

(76) Inventor: William G. Hones, 17953 Marine View Dr., Seattle, WA (US) 98166

( * ) Notice: Subject to any disclaimer, the term of this patent is extended or adjusted under 35 U.S.C. 154(b) by 0 days.

This patent is subject to a terminal disclaimer.

(21) Appl. No.: 09/637,001

(22) Filed: Aug. 14, 2000

Related U.S. Application Data

(63) Continuation-in-part of application No. 09/346,310, filed on Jul. 2, 1999, now Pat. No. 6,152,381, which is a continuation-in-part of application No. 09/239,670, filed on Jan. 29, 1999, now Pat. No. 6,149,070.

(51) Int. Cl.[7] ..... B05B 17/04; B05B 17/08

(52) U.S. Cl. ..... 239/12; 239/16; 239/17; 239/20; 239/23; 239/193; 261/37; D23/201

(58) Field of Search ..... 239/16, 17, 18, 239/20, 23, 193, 12; 261/37; D23/201

(56) References Cited

U.S. PATENT DOCUMENTS

| | | | | |
|---|---|---|---|---|
| 1,689,790 A | | 10/1928 | LeFevre, Jr. | |
| 1,837,225 A | | 12/1931 | Lipski | |
| 3,174,688 A | | 3/1965 | Chatten | |
| 4,149,674 A | * | 4/1979 | Fukamizu et al. | 239/20 |
| 4,747,538 A | * | 5/1988 | Dunn et al. | 239/20 |
| 4,823,409 A | | 4/1989 | Gaffney et al. | |
| 4,830,887 A | | 5/1989 | Reiter | |
| 4,836,142 A | | 6/1989 | Duback | |
| 4,881,280 A | | 11/1989 | Lesikar | |
| 4,886,210 A | | 12/1989 | Gaffney et al. | |
| 5,167,368 A | | 12/1992 | Nash | |
| 5,226,935 A | | 7/1993 | Wolff et al. | |
| 5,445,322 A | | 8/1995 | Formhals et al. | |
| 5,537,696 A | | 7/1996 | Chartier | |
| 5,571,409 A | | 11/1996 | Scarborough | |
| 5,738,280 A | | 4/1998 | Ruthenberg | |
| 6,149,070 A | * | 11/2000 | Hones | 239/17 |
| 6,152,381 A | * | 11/2000 | Hones | 239/17 |

FOREIGN PATENT DOCUMENTS

| | | |
|---|---|---|
| EP | 0 275 084 | 7/1988 |
| FR | 2 625 116 | 6/1989 |
| GB | 2 185 541 A | 7/1987 |

* cited by examiner

*Primary Examiner*—Robin O. Evans
(74) *Attorney, Agent, or Firm*—Blank Rome Comisky & McCauley, LLP

(57) ABSTRACT

A decorative and educational waterfall device has a substantially continuous film of a liquid, such as water, low viscosity oil or an aqueous solution, extending between spaced guide surfaces. The waterfall comprises a base reservoir in which is mounted an electrical pump. A liquid flow passage is mounted to the base and extends to a trough with a lip portion or a tank with a flow orifice from which water flows to form the waterfall between the spaced guide surfaces. The trough or flow orifice is configured to cause the flow of water to be directed outwardly toward the guide surfaces to improve the capability of the liquid to form a continuous film and the adherence of the liquid film to the guide surfaces.

15 Claims, 8 Drawing Sheets

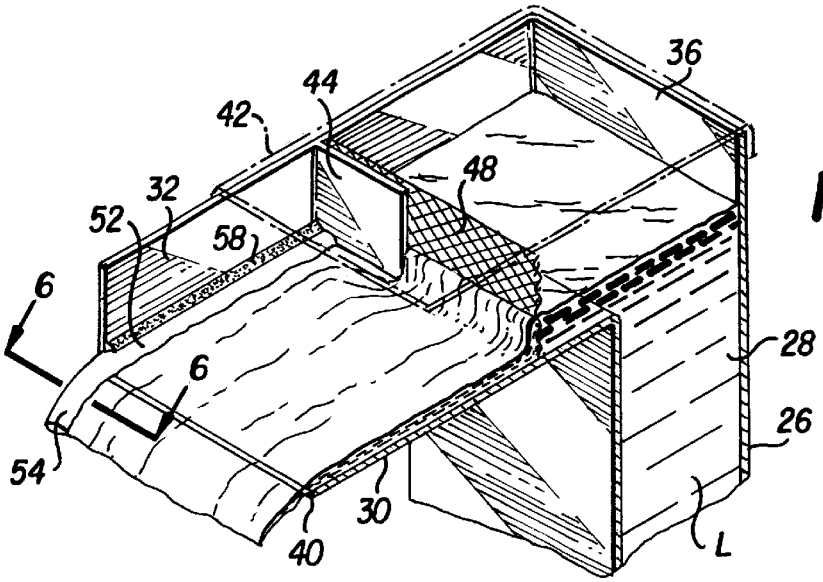
FIG. 4
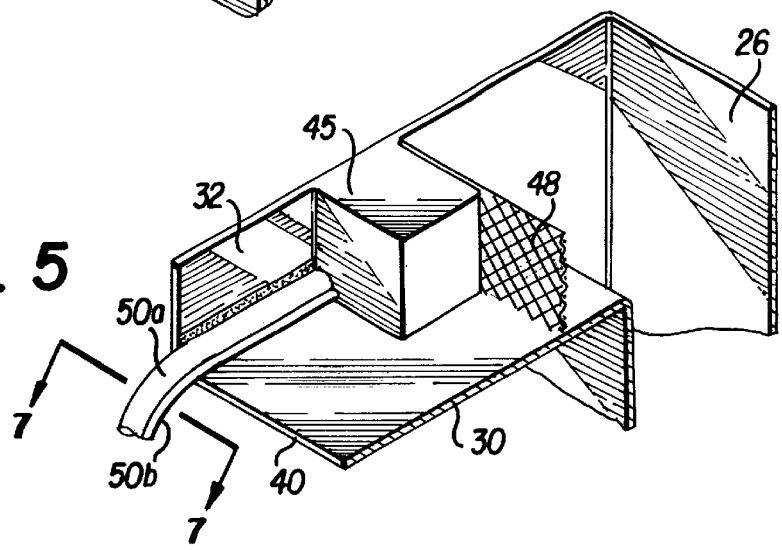
FIG. 5
FIG. 6
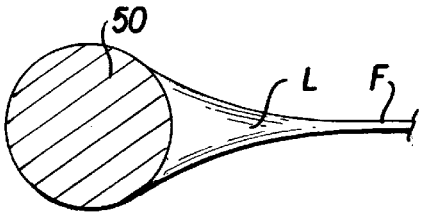
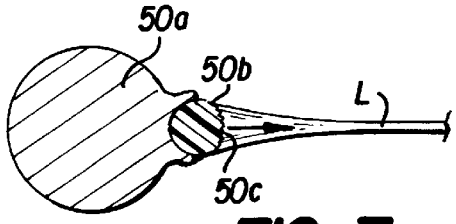
FIG. 7
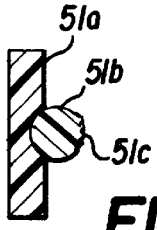
FIG. 8

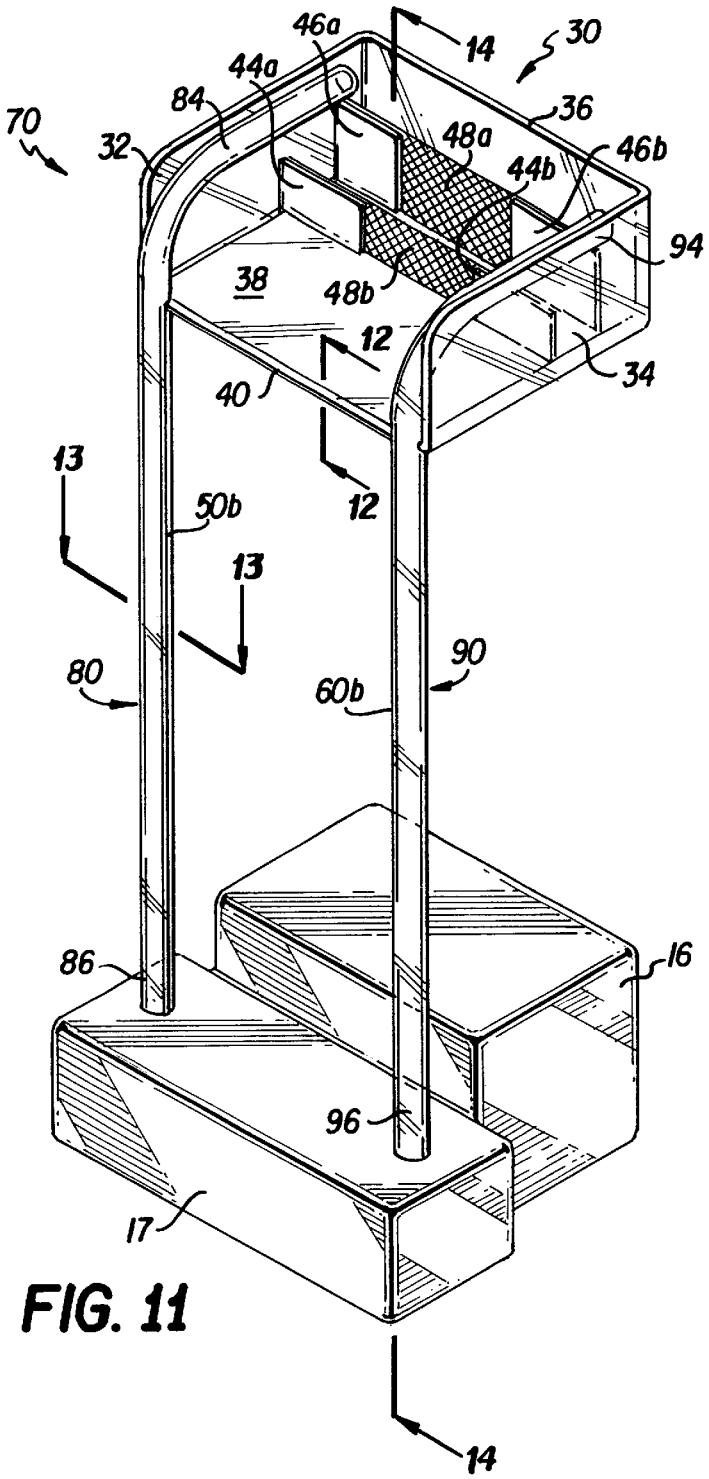
FIG. 11
FIG. 13
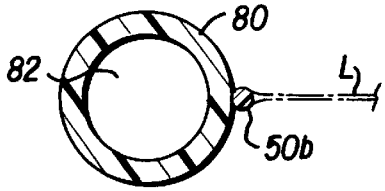
FIG. 12
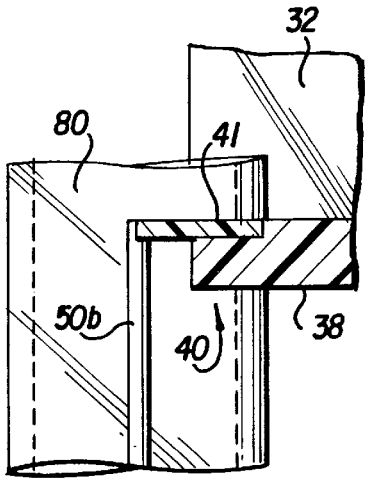

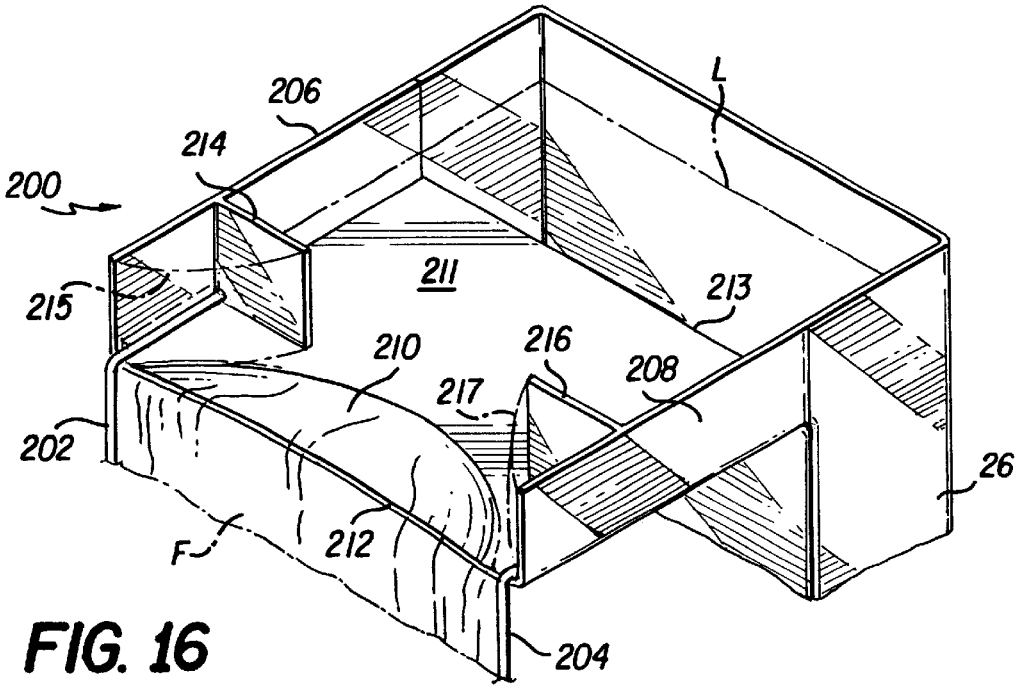
FIG. 16
FIG. 17
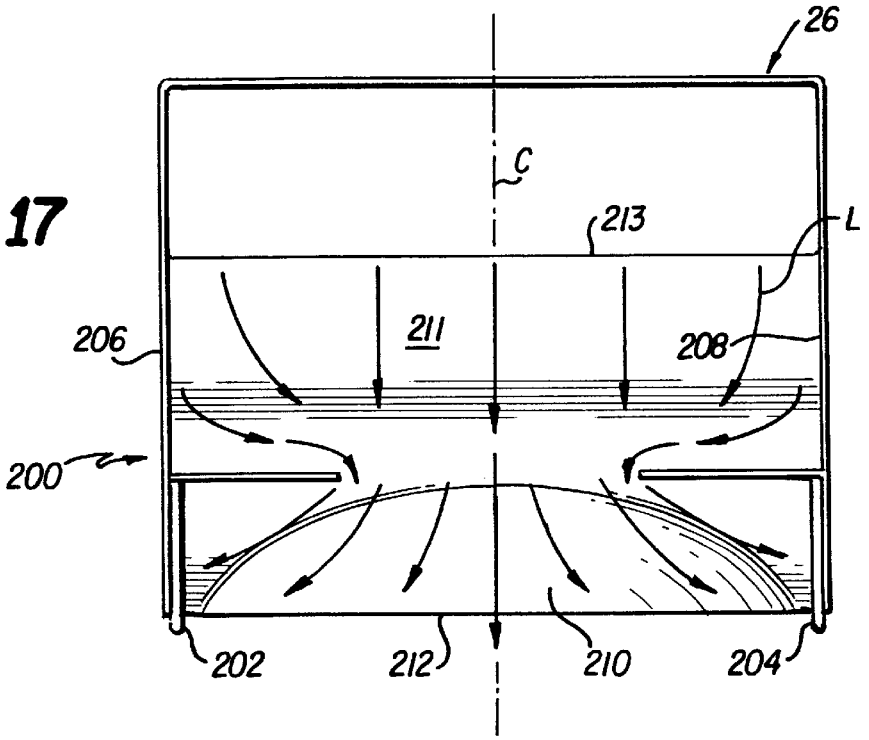
FIG. 18
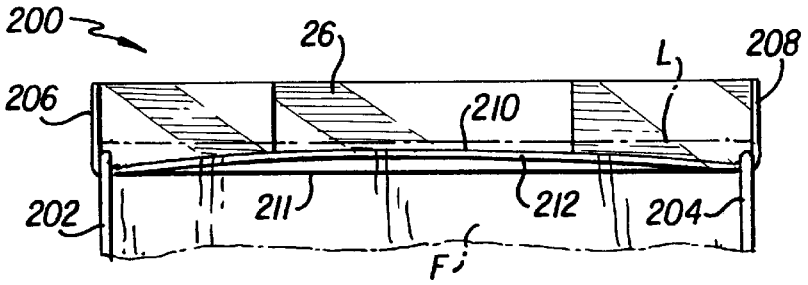

DECORATIVE WATERFALL DEVICE AND METHOD

CROSS-REFERENCE TO RELATED APPLICATIONS

This application is a continuation-in-part of U.S. patent application Ser. No. 09/346,310 filed Jul. 2, 1999, now U.S. Pat. No. 6,152,381, which is a continuation-in-part of U.S. patent application Ser. No. 09/239,670 filed Jan. 29, 1999, now U.S. Pat. No. 6,149,070.

FIELD OF THE INVENTION

The present invention relates to decorative and educational displays of a flowing liquid and more particularly to a decorative and educational waterfall device in which a substantially continuous film of a liquid, such as water, low viscosity oil or an aqueous solution, extends between two vertical guides and to a method of creating a decorative waterfall.

BACKGROUND OF THE INVENTION

Conventional decorative water or waterfall displays are typically constructed for indoor or outdoor use in pools, spas or the like. These water or waterfall displays generally use a plurality of water chambers and wide, flat spouts to create thick and discontinuous streams of water that fall a short distance into the pool or spa below. One of the problems with such devices is that they are primarily designed for use with large volumes of water, which makes it difficult to use the devices in indoor water displays. Moreover, such prior art waterfall displays do not form a continuous film or layer of downwardly flowing water, but rather form thick, turbulent streams which tend to splash and are not particularly attractive as a decorative display. Additionally, the waterfall produced by such devices tends to separate into one or more generally cylindrical streams of water as it falls because of the strong surface tension of water that tends to pull the water flow together. Examples of such devices are disclosed in U.S. Pat. Nos. 4,881,280 to Lesikar; 5,537,696 to Chartier; and 5,738,280 to Ruthenberg.

Decorative indoor water displays are known in the art. However, the known indoor water displays do not create an unsupported film or laminar sheet of water. Instead, such displays are characterized by flowing water over a solid or broken solid surface, such as an inclined or vertical plate. The water adheres to the plate surface as it cascades down. Such displays do not create a transparent film of water, but merely flow water over an existing structure to create a rippling effect. An example of such a device is disclosed in U.S. Pat. No. 4,747,583 to Dunn et al.

Indoor displays that are used to advertise oil are known in the art. One of the problems associated with the existing advertising display devices is that in order to function, they require the use of viscous fluids, such as lubricating oil. U.S. Pat. No. 1,689,790 to Lefevre, Jr. discloses an oil display device. Lefevre, Jr. however, is limited to maintaining a thin film of viscous liquid. The device relies on the high viscosity of the liquid displayed to create a film. Another problem associated with the Lefevre, Jr. device is that in order to maintain contact between the viscous liquid and two guides, it relies on forming the guides such that they converge at the bottom of the device. As a result of these deficiencies, the device disclosed would not be able to maintain a film of aqueous liquid. Similarly, U.S. Pat. No. 1,837,225 to Lipski discloses an oil display device for displaying cyclic movement of an oil film, and is adapted for use only with lubricating oils and other liquids with high molecular adhesion. The Lipski device is similarly not suited for low viscosity liquids, such as water or aqueous liquids which have low molecular adhesion and high molecular cohesion.

The devices disclosed in the aforementioned patents suffer from many deficiencies as described above. It would be desirable, therefore, to provide a decorative and educational indoor waterfall which utilizes a low viscosity liquid, such as water or other aqueous liquid, to form an attractive display of a continuous liquid film between two limiting guides. From the standpoint of education, it would be desirable to provide a waterfall device that is not only decorative, but also is suitable for use as a demonstrative aid in teaching the physics of liquid flow, surface tension and other hydrodynamic concepts.

SUMMARY OF THE INVENTION

In view of the foregoing limitations of the prior art devices, as well as other disadvantages not specifically mentioned above, it should be apparent that there exists a need in the art for an indoor waterfall which can be used for decorative and educational purposes as well as for humidifying a space. It is therefore a primary objective of this invention to fulfill those needs by providing a decorative waterfall device that forms an attractive, substantially continuous film of water or aqueous liquid between a pair of vertically upstanding guides and that can be used educationally to explain hydrodynamic concepts. It is also an objective of this invention to provide a method of creating a decorative waterfall by forming a thin, continuous water film between two upstanding guides.

It is also an objective of the present invention to provide a decorative waterfall in which a readily available liquid, such as water or other aqueous liquid, can be used to create an attractive waterfall device with a continuous liquid film.

It is a further objective of the present invention to provide a decorative waterfall device which is easily maintained such that the device does not require the cleaning of slippery, messy lubricating oils from the device and its surroundings.

It is an additional object of the present invention to provide a pleasant, unique and attractive decoration suitable for indoor or outdoor use.

Still another objective of the present invention is to provide a waterfall device that can be used to humidify the air in the space surrounding the waterfall device.

Yet another object of the present invention is to create a soothing environment with the soft susurrus of water.

A further object of the invention is to provide an interactive educational device for teaching fluid dynamics concepts, such as surface tension, laminar and turbulent flow and the like.

It is another objective of the invention to provide a decorative waterfall device with a light source for illuminating a continuous water film or for projecting an image onto the film to enhance the attractiveness and utility of the waterfall device.

It is a further objective of the invention to provide a decorative waterfall device made of a synthetic stone material with a three dimensional or bas relief sculpture, fresco, mural or the like located behind the sheet or film of water that forms the waterfall.

Yet another object of the invention is to provide a method of starting the decorative waterfall of the invention.

With the foregoing and other objects, advantages and features of the invention that will become hereinafter apparent, the nature of the invention may be more clearly understood by reference to the following detailed description of the invention, the appended claims and to the several views illustrated in the attached drawings.

BRIEF DESCRIPTION OF THE DRAWINGS

FIG. 4 is a fragmentary perspective view of the first embodiment of the waterfall device of the present invention, illustrating the flow of the water through the waterfall device;

FIG. 5 is a fragmentary perspective view of the first embodiment of the waterfall device of the present invention, illustrating an alternate embodiment of certain components of the waterfall device;

FIG. 6 is a transverse cross-section of the liquid guide of the present invention shown in FIG. 4, taken along line 6—6;

FIG. 7 is a transverse cross-section of the liquid guide of the present invention shown in FIG. 5, taken along line 7—7;

FIG. 8 is a transverse cross-section of an alternate embodiment of the liquid guide of the present invention;

FIG. 11 is a perspective view of the second embodiment of the waterfall device of the present invention;

FIG. 12 is a fragmentary cross-sectional detail of an alternate embodiment of the trough lip of the present invention taken along line 12—12 of FIG. 11;

FIG. 13 is a transverse cross-section of the tubular guide of the second embodiment of the present invention taken along line 13—13 of FIG. 11;

FIG. 16 is a fragmentary perspective view of the trough of another embodiment of the waterfall device of the present invention;

FIG. 17 is a top plan view of the trough of FIG. 16 showing the approximate flow directions of the fluid flowing over the trough;

FIG. 18 is a fragmentary front elevation view of the trough of FIG. 16;

DETAILED DESCRIPTION OF THE INVENTION

Figure 1:
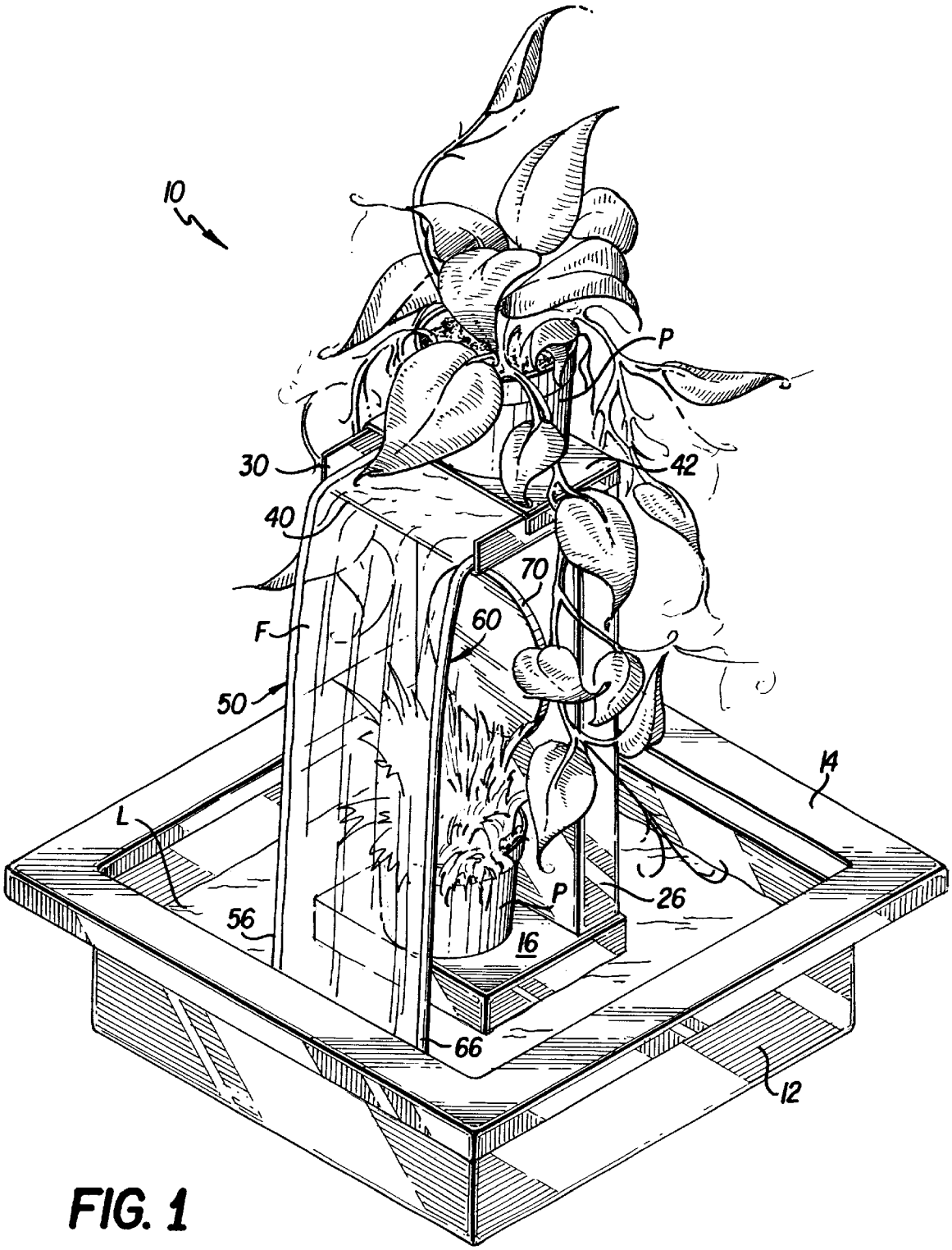
FIG. 1 is a perspective view of the first embodiment of the decorative waterfall device of the present invention, illustrating the waterfall device in use and decorated with plants.
Figure 3:
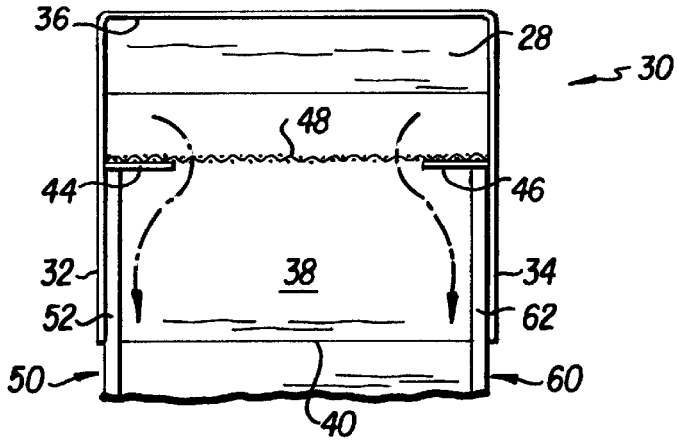
FIG. 3 is a top view of the first embodiment of the waterfall device of the present invention with the top cover removed, illustrating the water flow over the top surface or trough of the waterfall device.

Reference will now be made in detail to the preferred embodiments of the invention illustrated in the accompanying drawings, wherein like parts are designated by like numerals throughout. FIGS. 1–22 illustrate exemplary embodiments of the waterfall device of the invention which is designated generally in FIG. 1 by reference numeral 10.

A unique physical property of water is its very high surface tension compared with the surface tension of other liquids. Surface tension is that property of liquids arising from unbalanced molecular cohesive forces at or near the surface, as a result of which the surface tends to contract. For example, surface tension keeps water droplets whole instead of allowing the water to spread out as a film. Likewise, surface tension pulls a broad stream of water at the opening of a faucet into a more narrow stream as it falls from the faucet. Because of the high surface tension of water and aqueous liquids, it is extremely difficult, if not impossible to maintain a film of water, for example, in an annular ring or between a pair of wires or rods. In contrast, it is relatively easy to create a film of oil in an annular ring or between a pair of wires or rods. A surfactant, such as a liquid soap, is typically necessary to reduce the surface tension of water sufficiently to permit the formation of a thin aqueous liquid film, such as an aqueous soap solution used for blowing bubbles through an annular ring.

Another physical property unique to water is its low viscosity. Viscosity is the measure of the degree to which a fluid resists flow under an applied force. The viscosity of water is very low, for example at 15° C. and 16° C., the viscosity of water is 1.1 centipoise. In contrast, the viscosity of light machine oil at 15.6° C. is 113.8 centipoise. Similarly, heavy machine oil has a viscosity at 15.6° C. of 660.8 centipoise. The high viscosity of oil allows the oil to form a continuous film in an annular ring or between a pair of wires or rods Water alone, with its very low viscosity, ordinarily cannot maintain a continuous film in an annular ring or between a pair of wires or rods.

Figure 2:
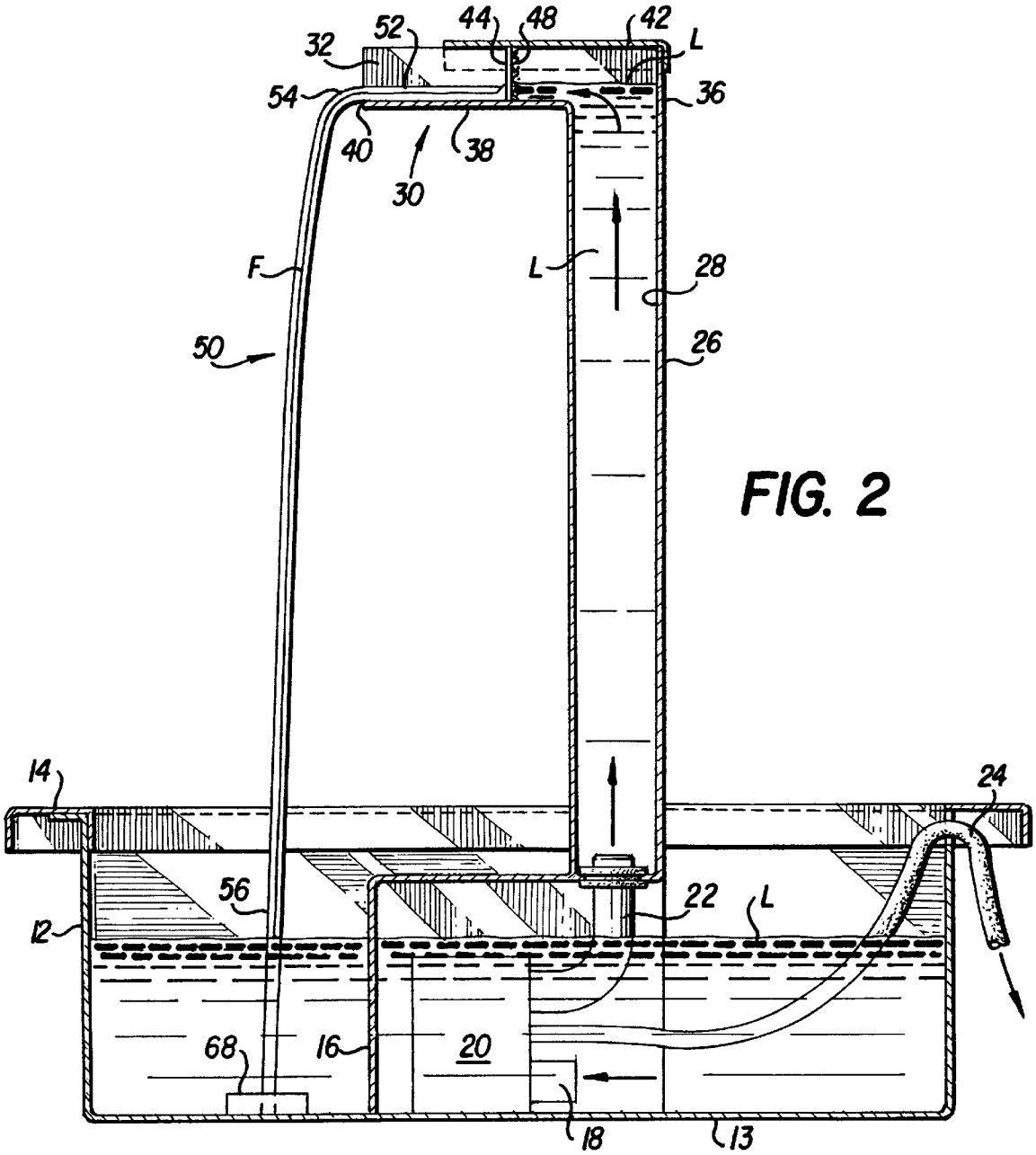
FIG. 2 is a side elevation view in cross-section of the first embodiment of the waterfall device of the present invention, taken along line 2—2 of FIG. 9.

Referring now in detail to FIGS. 1–4, a first embodiment of the waterfall 10 is illustrated in operation. The waterfall 10 comprises a base reservoir 12 formed with a flange or sill 14, in which is mounted a pump housing 16 partly submerged in water or an aqueous liquid L contained in the base reservoir 12. Located within the pump housing 16 is a liquid inlet 18, pump 20 and pump outlet conduit 22 (FIG. 2). Extending from the pump housing 16 is a power cord 24 adapted to be connected to a suitable source of electrical energy for the pump, e.g., household 110 volt power. A tower 26, containing a tower flow passage 28 through which water or aqueous liquid L can flow, is mounted to the top of pump housing 16 overlying the pump outlet conduit 22 and extends upwardly for a distance of up to about 24 inches. The tower 26 is mounted and sealed to the pump housing 16 in such a manner as to allow water or aqueous liquid L to pass from the pump outlet 22 through the tower passage 28 without leaking from the tower 26. It will be appreciated that the base reservoir 12 could be replaced by an upper reservoir (not shown) located above the trough 30 with the pump 20 connected to pump the water or aqueous liquid L from the base 12 via a pipe or tube (not shown) to the upper reservoir.

Mounted to the top of tower 26 is a water trough 30. The trough 30 has two side walls 32, 34, a rear wall 36, and a bottom wall 38 which terminates in a lip portion 40 at the front end of the trough 30. A trough cover 42 rests on the side walls 32, 34 and rear 36 walls of the trough 30, on which cover 42 as well as pump housing 16 maybe situated decorative items such as plants P, as illustrated in FIG. 1.

One or more flow restrictors 44, 46 and a screen 48 are mounted transversely across the trough 30 as shown in FIG. 2, substantially parallel to the lip portion 40, such that the restrictors 44, 46 and screen 48 are located in the flow path of the water or aqueous liquid L. It has been found that the restrictors 44, 46 and screen 48 decrease the turbulence of the flowing liquid L and improve the capability of the water or aqueous liquid to form a continuous film F of aqueous liquid L.

It is contemplated that, within the scope of the invention, more than one screen 48 and more than one pair of restrictors 44, 46 may be utilized. The restrictors 44, 46 and screen 48 decrease the turbulence and any eddy currents in the flow of water or aqueous liquid L such that substantially laminar or non-turbulent flow of the water or aqueous liquid L is achieved. It is contemplated that any turbulence dampening members, such as screens, restrictors and/or gates mounted to the trough 30, may be used to decrease the turbulence of the water or aqueous liquid L to provide the desired laminar or non-turbulent flow.

Two guide elements 50, 60 having respective upper end portions 52, 62, intermediate arcuate portions 54, 64 and lower end portions 56, 66, are mounted to the trough 30 at their upper end portions 52, 62. The guide elements 50, 60 are preferably cylindrical and should have a diameter which insures the guide elements are sufficiently rigid to withstand the surface tension forces and support the film. Diameters of about 0.125 inches or more have been found to be sufficient.

It has been found that small diameter liquid guides, such as monofilament, multifilament or stranded line or wire having diameters less than 0.125 may also be used if the line or wire is placed under tension or kept taut so as to resist the inward pull of the surface tension of the liquid film. In one example shown and described in connection with FIGS. 16–18, monofilament line having a diameter of about 1 mm or 0.04 inches has been successfully used to form a continuous liquid film approximately 5 inches wide at a flow rate of about 1 gallon per minute. When monofilament line is used in the foregoing example, the line preferably extends downwardly from the lip portion at approximately right angles as shown in FIGS. 16–18. The lower ends of the monofilament line are preferably placed under tension by means of coil springs or the like anchored in the base reservoir 12.

In one embodiment, the guide elements 50, 60, may be mounted to the side walls 32, 34 by guide holders 58 (only one shown in FIG. 4). The guide elements 50, 60 extend from the lip portion 40 of the trough 30 downwardly into the base reservoir 12, such that the lower portions 56, 66 of the guide elements 50, 60 engage a guide spacer 68 suitably fixed to the bottom wall 13 of base 12 adjacent the pump housing 16.

Water or other aqueous liquid L fills the base reservoir 12 and is pumped by pump 20 along a flow path from the base reservoir 12, into the pump housing 16, through the liquid inlet 18 of the pump, out the pump outlet conduit 22, up through the tower flow passage 28 to the rear portion of the trough 30. The liquid L then flows over the trough 30, around the restrictors 44, 46, through screen 48, and over the lip portion 40 of the trough 30. The liquid L contacts and adheres to the guide elements 50, 60, maintaining a continuous film F of aqueous liquid L between the guide elements 50, 60 from the arcuate guide portions 54, 64 at lip portion 40, to the lower end portions 56, 66 of the guide elements, until the liquid film F contacts the surface of the water or aqueous liquid L filling the base reservoir 12. In this manner, the aqueous liquid L is continuously recycled, and maintains a continuous liquid film F between the guide elements 50, 60. Without limiting the invention in any respect, it is believed that the restrictors 44, 46 impart to the flowing liquid L on either side of the centerline of the trough an outwardly directed flow component downstream of the restrictors so that the continuous film F adheres to the guide elements 50, 60 more tenaciously.

It is contemplated that the component parts of the waterfall 10 may be manufactured from a metal or plastic which will not oxidize or corrode when in contact with an aqueous liquid for extended periods of time, such as stainless steel, or acrylic or polycarbonate plastic. Alternatively, the waterfall 10 may be manufactured from a metal, such as copper, which oxidizes when in contact with air and water or aqueous liquid L for extended periods. The copper, upon oxidizing, will develop a blue or green patina, which will enhance the decorative aspect of the waterfall 10. The waterfall components, such as the base reservoir 12 and tower 26, may also be formed of rock or stone, which may be a synthetic plastic stone simulating material, to give it a more natural appearance. The tower 26 may be formed as a stone slab with a sculpture, fresco or other artwork mounted in front of or in bas relief on the stone slab with the passage for the water or aqueous liquid L comprising a pipe or tube extending from the pump to the trough inlet.

It is further contemplated that certain low viscosity oils may be used in lieu of water or aqueous liquid L. Alternatively, additives such as coloring agents, maybe added to water to create a colored film F of aqueous liquid L. The liquid film may, however, remain clear and transparent, or may be translucent or opaque. The additives should not substantially increase the viscosity of the aqueous liquid L.

It is also contemplated that aqueous liquid L may flow from the pump outlet 22 to the trough 30 by any number of liquid flow members. Although a tower 26 is one preferred embodiment, rubber tubing, or a series of hollow tubes of any shape may be used as a conduit for liquid L between the pump outlet 22 and the trough 30. Alternatively, it is contemplated that the waterfall 10 can maintain a continuous liquid film F from a liquid source (not shown) located above the waterfall 10. For example, water from a faucet might be directed or piped onto the trough 30 so that no pump is necessary to operate the waterfall 10 with a continuous liquid film F between the guide elements 50, 60.

In one embodiment of the tower 26, illustrated in FIG. 1, a light fixture 70 is located on the tower 26 adjacent to the liquid film F. It is contemplated that the light fixture 70 (not shown in detail) could be comprised of a light source, lens member and image transparency, which are arranged such that a visible image is projected from the transparency onto the liquid film F as described in more detail hereinafter in connection with FIG. 14.

It has been found that when the decorative waterfall of the present invention is initially started, i.e., when the pump is energized each time it is desired to operate the waterfall device, the flowing liquid does not immediately or initially adhere to one or both of the guides and form the continuous liquid film. In such cases, it has been discovered that a continuous film can be initiated manually by engaging the flowing liquid and the guide or guides simultaneously with the fingers or other implements and sliding them downwardly along the guide or guides. It is believed that this procedure helps to wet the guides and/or provide the necessary contact between the liquid and the guides to initiate the surface tension adherence between them.

Referring now to FIGS. 5–8, there are shown in greater detail alternate preferred embodiments of the trough 30 and guide elements 50, 60. In one preferred embodiment, the guide elements 50, 60 are each (only one shown) comprised of an outer guide element 50*a* and an inner guide element 50*b*, the inner guide element 50*b* having a roughened surface 50*c* (FIG. 7) for a purpose to be described. At least one of the inner guide elements 50*b* of the guide elements 50, 60 maybe formed from an acrylic rod or tube or fiber optical cable and functions as a light guide. It is contemplated that restrictors 44, 46 may be constructed with a light source 45 (FIG. 5) to illuminate the ends of inner light guide elements 50*b*. Light source 45 may be located at the bottom of the light guide as well. As a result of the roughened surfaces 50*c* of the inner light guides 50*b*, light entering the end of the light guides 50*b* will pass through the roughened surfaces 50*c* and will illuminate the liquid film F. It will be appreciated that a number of decorative enhancements may be employed using the light guides 50*b*. For example, the liquid L may be colored to display an illuminated colored liquid film F; the light source 45 may emit a variable color light to display a varying color film F; or the light source 45 from opposite sides of the device may emit synchronized or unsynchronized variable color lights.

FIG. 6 illustrates a transverse cross-sectional view of the single guide element 50 shown in FIGS. 1–4, showing a meniscus of liquid L from a water or aqueous liquid film F adhered thereto by surface tension. FIG. 8 illustrates a transverse cross-sectional view of an outer guide 51*a* and inner light guide 51*b* elements, showing the roughened surface 51*c* of the inner light guide 51*b*, and demonstrating an alternate shape of the outer guide element 51*a*. It should be noted that the shape of the outer guide element 51*a* is not of critical importance to the functionality of the waterfall 10. Fiber optic cable may have a diameter of about 0.25 to about 3 mm.

The arcuate portions 54, 64 of the guide elements 50, 60, may have various radii depending on the diameter of the guide elements and for monofilament guide elements the arcuate portions maybe substantially at right angles. It has been found that the radius of the arcuate portions 54, 64 is not critical to the operability of the invention. The guide elements 50, 60 maybe made of metal or plastic, such as a copper metal rod or an acrylic plastic rod.

Figure 9:
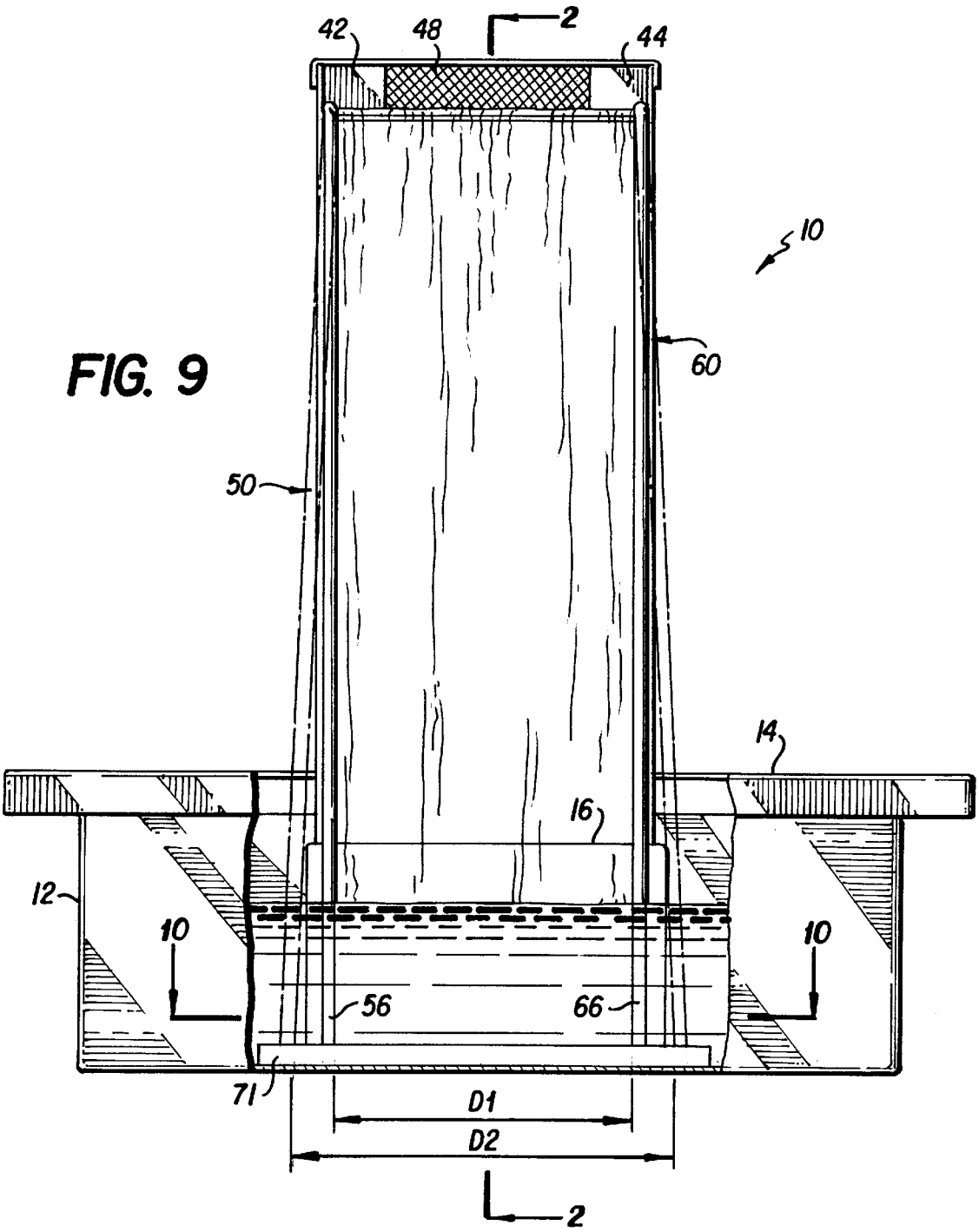
FIG. 9 is a front elevation view, partly broken, illustrating another feature of the first embodiment of the waterfall device of the present invention.
Figure 10:
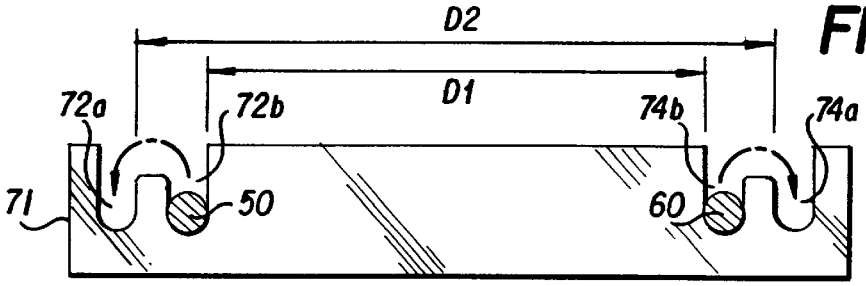
FIG. 10 is an top plan view of an alternate embodiment of the guide spacer of the waterfall device of the present invention taken along line 10—10 of FIG. 9.

Referring to FIGS. 9–10, there is shown in greater detail an arrangement of the guide elements 50, 60 with an alternate embodiment of a guide spacer 71. The guide elements 50, 60 may be arranged at distances of about one to ten inches or more apart. The guide elements 50, 60 may be maintained in equidistant relation to one another at their upper end portions 52, 62 and lower end portions 56, 66 as shown in FIGS. 1–4. Alternatively, the guide elements 50, 60 may diverge or converge as they extend toward the base reservoir 12. A guide spacer 71 may be provided to mate with the guide elements 50, 60 with a plurality of guide channels 72*a*, 74*a*, 72*b*, 74*b* in which the lower end portions 56, 66 of the guide elements 50, 60 are located at different spacings D1 and D2.

Referring now in detail to FIGS. 11–15, there is shown another preferred embodiment of a waterfall 70 according to the invention. This alternate embodiment comprises a pump housing 16 connected to a pump plenum 17 into which a pump 20 (FIG. 14) pumps a liquid, such as water or an aqueous solution, under pressure from the pump outlet 22. The waterfall device 70 is placed in a base reservoir similar to base reservoir 12 shown in FIGS. 1–2. Two tubular guides 80, 90, each containing a passageway 82, 92 through which water or an aqueous liquid L can flow, and each having an upper end portion 84, 94 and a lower end portion 86, 96, are mounted at their lower end portions 86, 96 to the pump plenum 17 and extend upwardly for a distance of up to about 24 inches. The tubular guides 80, 90 are formed such that the upper end portions 84, 94 and lower end portions 86, 96 are substantially perpendicular to one another. The tubular guides 80, 90 are mounted and sealed in such a manner to the pump plenum 17 as to allow water or aqueous liquid to flow from the pump plenum 17 through the tubular guides 80, 90 without leaking.

Mounted approximately parallel to the upper end portions 84, 94 is a trough 30, the trough 30 having two side walls 32, 34, a rear wall 36, and a bottom wall 38 which terminates in a lip portion 40. As shown in FIG. 12, if the bottom wall 38 of the trough 30 is thicker than about 0.0625 inches, the lip portion 40 may be formed as a separate piece 41 no thicker than about 0.0625 inches, in order to prevent aqueous liquid L from adhering to the lip portion 40 and running down the underside of the bottom wall 38 of the trough 30. One or more restrictors 44*a*, 44*b*, 46*a*, 46*b* and one or more screens 48*a*, 48*b* are mounted within the trough 30, substantially perpendicular to the lip portion 40, such that the restrictors and screens are located within the flow path of the aqueous liquid L. In one preferred embodiment, inner guide elements 50*b*, 60*b* are attached to the tubular guides 80, 90 such that the inner guide elements 50*b*, 60*b* confront one another (FIG. 13). The tubular guides 80, 90 may be manufactured from transparent or opaque plastic or metal.

The restrictors 44*a*, 44*b*, 46*a*, 46*b* and screens 48*a*, 48*b* may be arranged in any order, so long as the restrictors and screens decrease the turbulence of the aqueous liquid L such that the flow of the liquid L is substantially laminar or non-turbulent.

Figure 14:
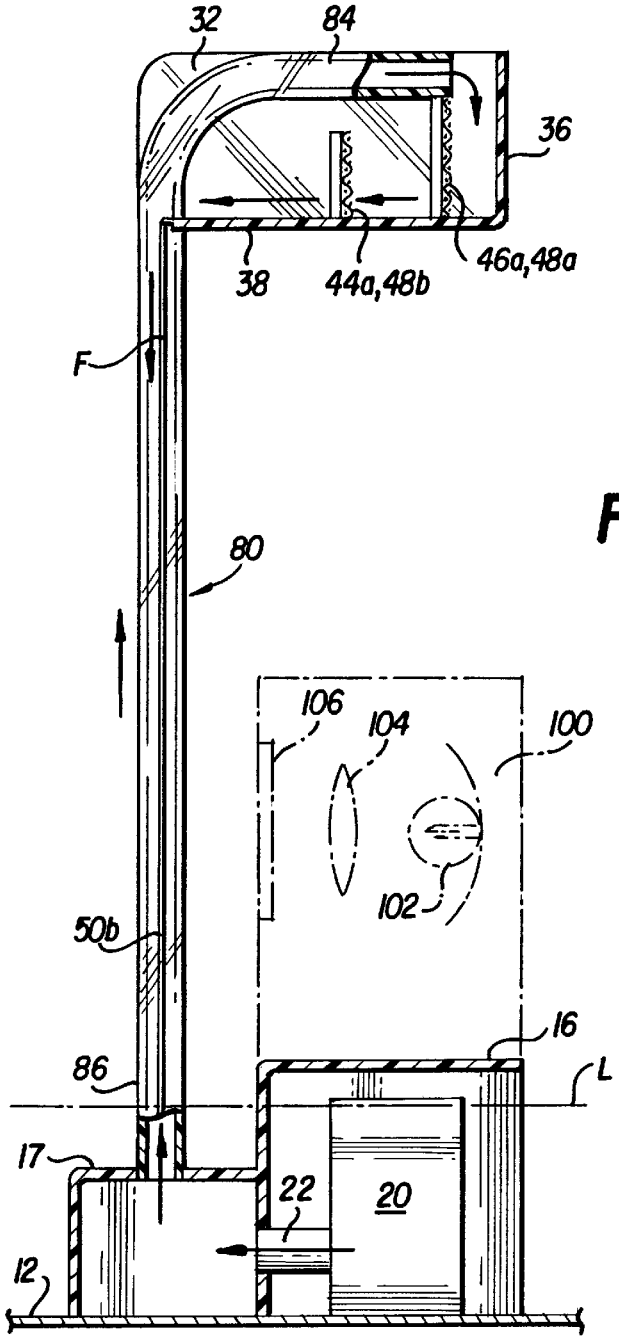
FIG. 14 is a side elevational view in cross-section of the second embodiment of the present invention taken along line 14—14 of FIG. 11.

Water or other aqueous liquid L contained in a base reservoir (not shown in FIG. 11) is pumped by pump 20 from the pump housing 16 through pump outlet 22 into the pump plenum 17 under pressure. From the pump plenum 17 the liquid L is pumped up through the tubular guide passageways 82, 92 and is discharged onto the trough 30 proximate to the rear wall 36 (FIG. 14). The liquid L then flows over the trough 30, around the restrictors 44*a*, 44*b*, 46*a*, 46*b*, through the screens 48*a*, 48*b* and over the lip portion 40 of the trough 30. The liquid L contacts and adheres to the guide elements 80, 90, maintaining a film F of liquid L between the guide elements 80, 90 until the liquid film F contacts the surface of the liquid L in the base reservoir. In this manner, the liquid L is continuously recycled, and maintains a continuous film F between the guide elements 80, 90.

In an alternative embodiment, only one inner guide element 50*b* is used, the inner guide element 50*b* being attached to one tubular guide 80 such that it confronts the other tubular guide 90. Additionally, one or both of the inner guide elements 50*b*, 60*b* may, as in the in the earlier-described embodiment, be fashioned from a fiber optic cable. The inner guide elements 50*b*, 60*b* may have roughened surfaces in order that light may pass through the roughened portion of the fiber optic cable through the aqueous liquid.

Figure 15:
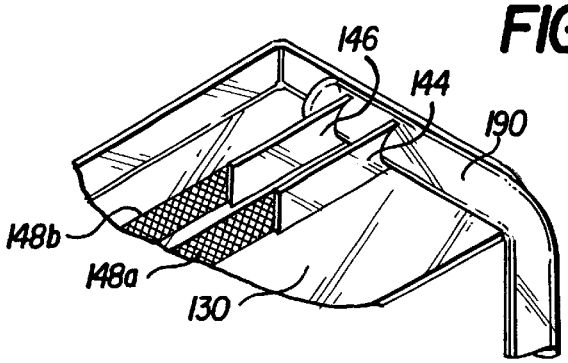
FIG. 15 is a fragmentary detail, showing an alternate embodiment of the trough of the second embodiment of the present invention illustrating the arrangement of the tubular guide and restrictor.

FIG. 15 illustrates an alternate embodiment of the construction of a trough 130 with a tubular guide 190 and restrictors 144, 146 and screens 148*a*, 148*b*. In this embodiment, the components except the screens 148*a*, 148*b* are preferably injection molded as a integral assembly. It will be apparent that the height of the trough 130 is substantially reduced over the trough 30 shown in FIG. 14.

FIG. 14 also illustrates an optional feature of the second embodiment of the invention. According to this option, a light fixture 100 is mounted on the pump housing 16 in spaced relation to the liquid film F extending between the guides 80, 90. Light fixture 100 comprise a light source 102, lens member 104, and an image transparency 106, which are arranged such that a visible image is projected from the transparency 106 onto the liquid film F between the tubular guides 80, 90.

FIGS. 16–18 illustrate another embodiment of a trough 200 that has been found to be particularly effective in maintaining a continuous film F of liquid between the guide elements 202, 204. In this embodiment, the guide elements 202, 204 are formed of transparent monofilament line having a diameter of about 1 mm. Consequently, the guide elements extend downwardly from the trough 200 at approximately right angles as shown in FIG. 16. Since the monofilament guides 202, 204 are flexible, they are preferably placed in tension by application of a downward force to the lower end of the monofilament. Tensioning of the monofilament guides 202, 204 can be accomplished, for example, by anchoring the lower ends of the monofilament guides to the base reservoir 12 or to an element in the base reservoir, such as a weight or the guide spacer 71 (FIG. 10), or any suitable anchoring means. A coil spring (not shown) may also be used to anchor the monofilament line to the base reservoir or to an element in the base reservoir.

Using the form of the trough 200 shown in FIGS. 16–18, a waterfall device has been constructed having a width of about ten inches with a water drop or height of about fifteen inches. The trough 200 is formed with two vertical sidewalls 206, 208 and a convex (as viewed from above the trough) or raised hump portion 210 is formed in or on the bottom wall 211 of the trough. The convex or raised hump portion 210 is positioned adjacent lip portion 212 so that from the approximate centerline C of the trough the convex portion 210 causes an outwardly directed flow component of the liquid toward both sidewalls 206, 208 as best seen by referring to the arrows in FIG. 17. It is believed that this outwardly directed flow component helps to counteract the tendency of the liquid film F to pull away from the guides 202, 204 and accelerate toward the center of the waterfall. While the shape of the hump or convex portion 210 may vary, it is desirable that the greatest height of the raised hump portion be disposed along the centerline of the trough 200 at the edge of the lip portion. For a trough 200 having a width of about five inches, the dimensions of a hump portion that has been found to operate according to the invention are approximately as follows. The hump portion 210 has a height at the lip portion 212 and at the centerline C of the trough 200 about ⅛ inch higher than its height adjacent the sidewalls 206, 208; has a width of about 5 inches; and decreases in height rearwardly from the lip portion 212.

The trough may be formed of a polymeric or plastic material, metal, stone or other suitable material. When the trough is formed of a polymeric or plastic material, the raised hump portion may be formed by injection molding or by bonding or otherwise attaching a hump portion to the bottom wall 211 of the trough. When the trough is formed of metal, the raised hump portion may be formed by stamping, rolling or by other metal forming process.

The trough 200 also includes a pair of restrictors 214, 216 extending perpendicularly from the sidewalls 206, 208. These restrictors not only reduce the turbulence of the liquid flowing over the trough, they also help to impart an outward flow to the liquid downstream of the restrictors in much the same way that a restrictive orifice does. The restrictors also prevent the "piling up" or depth increase of the flowing liquid adjacent the sidewalls of the trough. Such a "piling up" would otherwise create an inwardly directed flow of liquid that tends to pull the liquid film away from the guide elements 202, 204. The restrictors 214, 216 may also be in the form of generally triangular blocks as shown in dash-dot lines 215, 217 in FIG. 16 to reduce turbulence of the liquid flowing past the restrictors toward the lip portion 212.

The hump portion 210 has been shown as a convex portion of the bottom wall 211 of the trough 200 adjacent the lip portion 212. It will be appreciated that other equivalent forms of the hump portion maybe used. For example, the hump portion may be formed as planar portions of the bottom wall which taper downwardly from the centerline of the trough toward the sidewalls. The hump portion may also be formed in the bottom wall of the trough as a segment of a cylinder, the axis of which is parallel to the centerline of the trough. Other equivalent configurations will be apparent to those of ordinary skill in the art. Any configuration or shape of the trough and the bottom and side walls thereof which causes liquid flow with a flow component in a direction toward the liquid guides or which improves the adherence of the liquid film to the guides is considered equivalent.

It has been found that when the trough 200 is formed of a sheet metal, such as copper sheet, the bottom wall 211 may be rolled in a curved form with the lowest points in a common plane adjacent the sidewalls and the highest points along the centerline of the trough increasing in height from zero to a maximum at the edge of the lip portion 212 of the trough. The rear edge or lip 213 of the trough 200 is preferably deformed into a straight edge and affixed to a tower 26 such that the bottom wall transitions from a flat, substantially planar surface adjacent the rear edge 213 of the trough to a gradually increasing curvilinear surface with maximum curvature at the front lip portion 212 of the trough.

Figure 19:
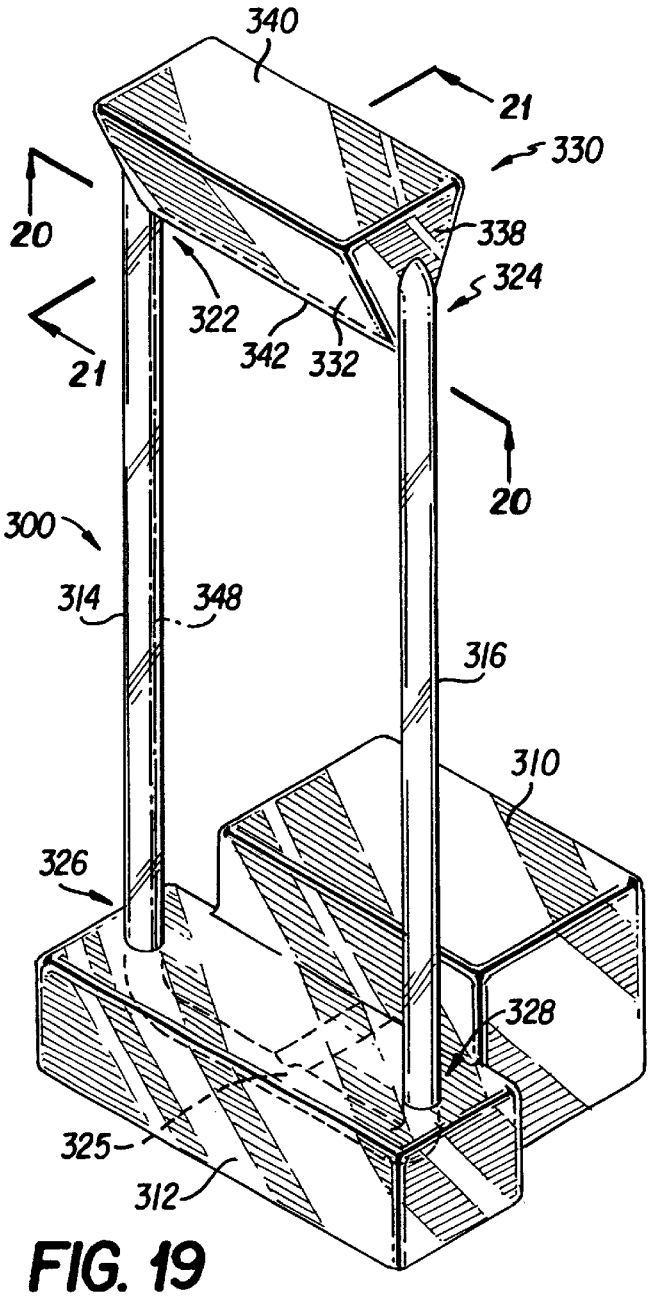
FIG. 19 is a perspective view of another embodiment of the waterfall device of the present invention with a flow orifice for forming the waterfall.

Another embodiment of the waterfall device of the invention is shown in FIGS. 19–22 and is designated by reference numeral 300. This alternate embodiment comprises a pump housing 310 connected to a pump plenum 312 into which a pump 20 (e.g., pump 20 of FIG. 14) pumps a liquid, such as water or an aqueous solution, under pressure from the pump outlet 22 (FIG. 14). The waterfall device 300 may be placed in a base reservoir similar to base reservoir 12 shown in FIGS. 1–2. Two tubular guides 314, 316, each containing a passageway 318, 320 (FIG. 20) through which water or an aqueous liquid L can flow, and each having an upper end portion 322, 324 and a lower end portion 326, 328, are mounted at their lower end portions to the pump plenum 312 and extend upwardly for a distance of up to about 24 inches. The tubular guides 314, 316 are formed such that the upper end portions 322, 324 are formed as right angled elbows. The tubular guides 314, 316 are mounted and sealed in such a manner to the pump plenum 312 as to allow water or aqueous liquid to flow from the pump plenum 312 through the tubular guides 314, 316 without leaking. As also shown in FIG. 19 in dash-dot lines, instead of a plenum 312, water or aqueous liquid may be pumped directly from the pump 310 to the tubular guides 314, 316 via a tee connection that is connected between the pump and the bottom portions 326, 328 of the guides.

Figure 21:
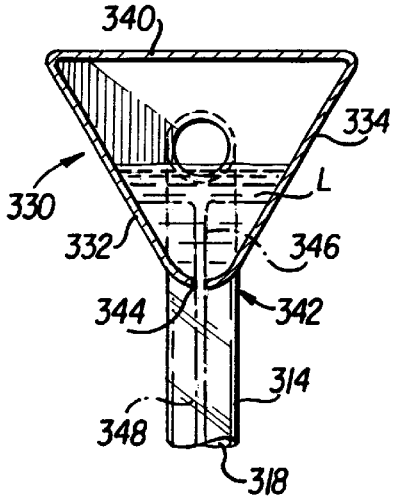
FIG. 21 is a cross-sectional view of the waterfall device of FIG. 19 taken along line 21—21.
Figure 22:
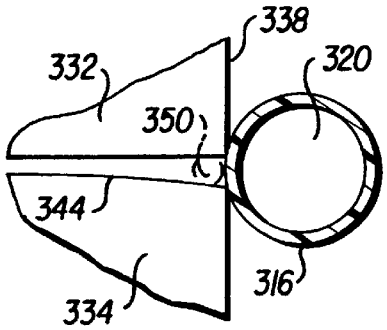
FIG. 22 is a fragmentary cross-section of detail 22—22 of FIG. 20 showing an alternate construction of the guide.

Mounted to the upper end portions 322, 324 is a tank or reservoir 330 having a generally triangular cross-section as best seen in FIGS. 19 and 21. Tank 330 is formed with a pair of inwardly sloping sidewalls 332, 334 and opposite vertical end walls 336, 338 through which the right angled elbows of the upper end portions 322, 324 extend. The tank 330 may also be provided with a top wall 340 which is preferably made in the form of a removable lid. Other cross-sectional shapes of the tank 330 are, of course, within the scope of the invention, such as, for example, circular, oval, square, rectangular and other polygonal shapes.

Figure 20:
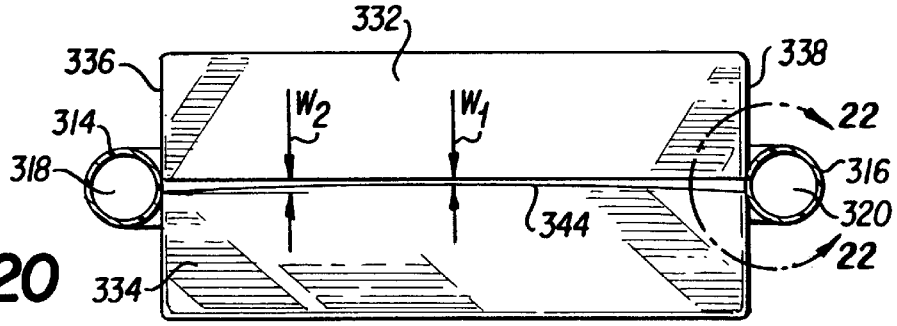
FIG. 20 is a cross-sectional view of the waterfall device of FIG. 19 taken along line 20—20 showing the flow orifice in relation to the tubular flow guides.

The apex or intersection 342 between the sloping sidewalls 332, 334 is oriented vertically downwardly and may be rounded as shown best in FIG. 21. An elongated flow slot or orifice 344 is formed in the bottom of the tank 330 along the intersection 342 and extends from one guide tube 314 to the other guide tube 316 as best seen in FIG. 20. As also shown in FIG. 20, the flow orifice 344 varies in width from the center of the orifice toward both guide tubes. The width $w_1$, at the center of the orifice increases gradually toward both guide tubes to a width $w_2$ for a purpose to be described.

The waterfall device 300 operates as follows. Water or other liquid medium L is pumped by a pump 20 in pump housing 310 to the pump plenum 312 under pressure from which it travels upwardly through the passageways 318, 320 in guide tubes 314, 316 and empties into the tank 330 from the upper tube portions 322, 324. The liquid L then flows through flow orifice 344 and attaches by surface tension to the guide tubes 314, 316 so as to form a thin, continuous liquid film between the guide tubes 314, 316. The varying width of the orifice (i.e., smaller width $w_1$ in the center and gradually increasing toward the guide tubes to a width $w_2$), creates a divergent liquid flow from the center of the orifice outwardly toward the guide tubes and advantageously improves the ability of the liquid flowing from the orifice to sustain the continuous liquid film between the guide tubes 314, 316. It will be appreciated by those skilled in the art that the foregoing dimensions may vary substantially depending on the size of the waterfall device and components, the volumetric flow rate of liquid and other design parameters. If it is desired to further improve the stability of the continuous liquid film flowing from the flow orifice 344, the orifice may be elongated vertically as shown in dash-dot lines at 346 in FIG. 21 so that the orifice is formed by two confronting, substantially planar surfaces that converge slightly at the midpoint between the guide tubes 314, 316.

In an alternate embodiment of the invention illustrated in FIGS. 19–22, the tank 330 may be supported above the plenum 312 or base reservoir by other means, such as by a tower similar to tower 26 with a flow passage 28 or by a tube or tubes with flow passageways connected, for example, to the sidewalls 332, 334 or top 340 of the tank 330. Instead of forming the continuous liquid film between the guide tubes 314, 316, the film may be formed between solid rods or monofilaments 348, 350 shown in dash-dot lines in FIGS. 19, 21 and 22.

It should be understood that a feature or features of one embodiment of the present invention may be combined with or utilized in other embodiments of the invention and that the claims herein are intended to cover such combinations or embodiments unless otherwise limited by the claims. In one non-limiting example, any embodiment of the invention may include guide elements (tubes, rods, monofilaments, etc.) that converge or diverge as explained in connection with the embodiment of FIGS. 9–10.

Although certain presently preferred embodiments of the present invention have been specifically described herein, it will be apparent to those skilled in the art to which the invention pertains that variations and modifications of the various embodiments shown and described herein may be made without departing from the spirit and scope of the invention. Accordingly, it is intended that the invention be limited only to the extent required by the appended claims and the applicable rules of law.

What I claim is:

1. A method of creating a decorative waterfall comprising the steps of:

flowing a liquid in a flow path having a centerline and components of flow divergent from the centerline of the flow path;

contacting said divergent components of flow with spaced apart guide surfaces so as to form said liquid in a substantially continuous film extending between said guide surfaces, said film being substantially free of contact with any surface in the space between the guide surfaces.

2. The method of claim 1, including the step of flowing the liquid over a non-planar surface to form the divergent flow components of the flow path.

3. The method of claim 1, including the step of flowing the liquid through a flow orifice having a width that increases from the centerline to the guide surfaces.

4. A method of creating a decorative waterfall comprising the steps of:

flowing a liquid in a flow path having a centerline and a flow path width, the flowing liquid having components of flow divergent from the centerline of the flow path;

providing a contact surface for forming a substantially continuous liquid film in contact with a portion of said contact surface, said substantially continuous liquid film being substantially free of contact with said contact surface over a substantial portion of said flow path width.

5. The method of claim 4, including the step of maintaining the flow path width of the flow path substantially constant.

6. A decorative waterfall comprising:

a flow channel for creating a liquid flow path having divergent components of flow; and a flow guide having surfaces contacted by liquid flowing from said flow channel so as to maintain a substantially continuous liquid film extending between said surfaces of the flow guide, said substantially continuous liquid film having a width and being substantially free of contact with said surfaces of the flow guide over a substantial portion of the width of said film.

7. The decorative waterfall of claim 6, wherein said flow channel has a non-planar surface for forming the divergent flow components of the flow path.

8. The decorative waterfall of claim 6, wherein said flow channel comprises a flow orifice having a midpoint and a width that increases from the midpoint to the flow guide surfaces.

9. A device for forming a waterfall comprising a source of liquid, a pair of liquid guides arranged in spaced relation to one another, said liquid guides having upper and lower end portions, a tank mounted adjacent the upper end portions of the liquid guides, a liquid flow member connected between the source of liquid and the tank, said tank having a flow orifice through which liquid from the source of liquid flows in an liquid path in contact with the guides to form a substantially continuous liquid film extending between the liquid guides from the flow orifice of the tank to the lower end portions of the guides.

10. The device of claim 9, wherein the flow orifice has a width and a midpoint, the width of the flow orifice increasing from the midpoint to the guides.

11. The device of claim 9, wherein at least one of the liquid guides is a tube and comprises the liquid flow member.

12. The device of claim 9, wherein said liquid guides each comprise a monofilament line.

13. A decorative waterfall device comprising:

a base having an aqueous liquid reservoir for containing water;

two liquid guides arranged in spaced relation to one another extending upwardly from the base, said liquid guides having upper and lower end portions, at least one of the liquid guides comprising a tubular member;

a tank having a flow orifice at the bottom thereof, the upper end portions of the liquid guides being mounted to the tank;

a pump arranged to pump aqueous liquid from the reservoir through the tubular member and into the tank whereby aqueous liquid discharged into the tank flows in an aqueous liquid flow path through to form a substantially continuous aqueous liquid film extending between the liquid guides from the flow orifice to the lower end portions of the liquid guides.

14. A method of starting a decorative waterfall comprising the steps of:

providing a source of liquid, a pair of liquid guides arranged in spaced relation to one another, said liquid guides having upper and lower end portions, a flow channel mounted adjacent the upper end portions of the liquid guides, a liquid flow member connected between the source of liquid and the flow channel from which liquid from the source of liquid flows in an liquid path in contact with the guides to form a substantially continuous liquid film extending between the liquid guides from the flow channel to the lower end portions of the guides;

starting the flow of liquid from the source to the flow channel;

contacting at least one of the liquid guides and the flowing liquid adjacent the upper end portion of said at least one of the liquid guides with an implement; and while maintaining the implement in contact with said at least one liquid guide and the flowing liquid, moving the implement downwardly along said at least one liquid guide toward the lower end portion thereof to cause the flowing liquid to adhere to said at least one liquid guide between the upper and lower end portions of such guide.

15. The method of claim 14, wherein the contacting step comprises the step of using a finger or fingers of the hand as the implement and the moving step comprises the step of manually moving the finger or fingers downwardly along said at least one liquid guide toward the lower end portion thereof to cause the flowing liquid to adhere to said at least one liquid guide.

* * * * *